US006225753B1

(12) United States Patent
Lee

(10) Patent No.: US 6,225,753 B1
(45) Date of Patent: May 1, 2001

(54) ELECTRONIC BALLAST THAT IS CONTROLLED BY THE OPERATION OF A SHARED SWITCH

(75) Inventor: Sang-Woo Lee, Bucheon (KR)

(73) Assignee: Fairchild Korea Semiconductor Ltd. (KR)

( * ) Notice: Subject to any disclaimer, the term of this patent is extended or adjusted under 35 U.S.C. 154(b) by 0 days.

(21) Appl. No.: 09/483,915

(22) Filed: Jan. 17, 2000

(30) Foreign Application Priority Data

Jan. 21, 1999 (KR) ..... 99-1784

(51) Int. Cl.[7] ..... H05B 37/00
(52) U.S. Cl. ..... 315/224; 315/209 R; 315/247
(58) Field of Search ..... 315/247, 224, 315/209 R, 244

(56) References Cited

U.S. PATENT DOCUMENTS 5,936,357 * 8/1999 Crouse et al. ..... 315/247

* cited by examiner

*Primary Examiner*—David Vu
(74) *Attorney, Agent, or Firm*—Blakely Sokoloff Taylor & Zafman

(57) ABSTRACT

Disclosed is an electronic ballast that comprises a rectifier receiving and rectifying the alternating current (AC) power and outputting a result; a first converter receiving the output current of the rectifier and changing levels of the voltage by the on and off operations of a first switch and outputting the result; a half bridge converter coupled to the first converter in parallel and comprising a first and second switches shared with the first converter, and receiving the output current of the first converter and changing the directions of the current flow according to the status of the first and second switches by the on and off operations of the second switch; and a resonance circuit, coupled to the half bridge converter, resonating the output current of the half bridge converter and converting the current into sine wave current and outputting the current to a discharge lamp. The ballast according to the present invention decreases production costs and increases the efficiency of energy transfer.

12 Claims, 4 Drawing Sheets

(PRIOR ART)

ELECTRONIC BALLAST THAT IS CONTROLLED BY THE OPERATION OF A SHARED SWITCH

BACKGROUND OF THE INVENTION (a) Field of the Invention

The present invention relates to an electronic ballast. More specifically, the present invention relates to an electronic ballast that has a small number of components and a high degree of efficiency.

(b) Description of the Related Art

An electronic ballast provides stable power to lighting apparatuses such as fluorescent lamps and discharge tubes.

Since the fluorescent lamp and discharge tube emit light via a discharge process, the polarity of the supplied power must be switched at predetermined periods. To supply such power, the electronic ballast is implemented with a converter. Typically, a boost converter, half bridge converter, and flyback converter are used.

A conventional electronic ballast will now be described with reference to the drawings.

Referring to FIG. 1, the conventional electronic ballast using the boost converter and half bridge converter comprises a rectifier 10, a boost converter 20, a diode D1, a capacitor C1, a half bridge converter 30, a resonance circuit 40, and a lamp Rlamp.

The rectifier 10 receives, rectifies, and outputs an alternating current (AC).

The boost converter 20 comprises a coil L1 and a switch S1, and receives the rectified power to boost the power to a predetermined level, after which the boost converter 200 outputs the result.

One end of the diode D1 is coupled to the coil L1 and the switch S1 and its other end is coupled to one end of the capacitor C1, the other end of the capacitor C1 being grounded. The diode D1 and capacitor C1 smooth the output of the boost converter 20.

The half bridge converter 30 is coupled to both ends of the capacitor C1 and comprises two switches S2 and S3. The half bridge converter 30 changes the polarities of the power by performing the switching operation on the voltage at the capacitor C1 at a predetermined period, and outputs the result so that AC power is supplied to the discharge tube.

The resonance circuit 40 comprises capacitors C2 and C3 and a coil L2, and resonates the output power of the half bridge converter 30 to convert the output power to AC power having a predetermined frequency. After this conversion, the resonance circuit 40 supplies the AC power to the lamp Rlamp.

As shown in FIG. 2, the electronic ballast using the conventional flyback converter and half bridge converter comprises a rectifier 10, a flyback converter 50, a diode D1, a capacitor C1, a half bridge converter 30, a resonance circuit 40, and a lamp Rlamp.

The flyback converter 50, by the on and off operation of a switch S1, receives an output power of the rectifier 10 from a primary coil of a transformer T1, performs conversion of the power, then transmits the result to a secondary coil of the transformer T1.

In the above-noted conventional electronic ballast, a system having a boost converter connected to a half bridge converter, and another system having a flyback converter connected to a half bridge converter are described. The overall performance of such systems decreases as a result of these inefficient interconnections. Also, since the elements are physically coupled, the size of the circuit increases with an increase in the number of components, and overall reliability decreases. Manufacturing costs also go up with such configurations.

SUMMARY OF THE INVENTION

It is an object of the present invention to provide an electronic ballast that has a small number of components and obtains a high level of performance.

In one aspect of the present invention, an electronic ballast comprises a a rectifier receiving and rectifying an alternating current (AC) power and outputting a resulting output current; a first converter receiving the output current of the rectifier and changing levels of the voltage by the on and off operations of a first switch and outputting a resulting output current; a half bridge converter coupled to the first converter in parallel and comprising first and second switches shared with the first converter, the half bridge converter receiving the output current of the first converter and changing a flow direction of the current according to on and off states of the first and second switches; and a resonance circuit, coupled to the half bridge converter, resonating an output current of the half bridge converter to convert the current into a sine wave current and outputting the current to a discharge lamp.

The electronic ballast further comprises a first diode that is coupled between the first converter and the half bridge converter in the forward direction of the half bridge converter and prevents reverse flow from the half bridge converter to the first converter; and a first capacitor that is coupled to the first diode, the half bridge converter, and the ground, and smoothes and maintains the output current of the first converter.

The first converter is a boost converter or a flyback converter.

The second switch of the half bridge converter is coupled to the first capacitor, first diode, and first switch, and shares the first switch with the first converter, the first and second switches performing opposite on and off operations such that when the first switch is controlled to on the second switch is controlled to off and vice versa.

The resonance circuit comprises a second capacitor coupled to the first and second switches; a second inductor coupled to the second capacitor; and a third capacitor coupled between the second inductor and the ground.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

In the following detailed description, only the preferred embodiment of the invention has been shown and described, simply by way of illustration of the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

Figure 1:
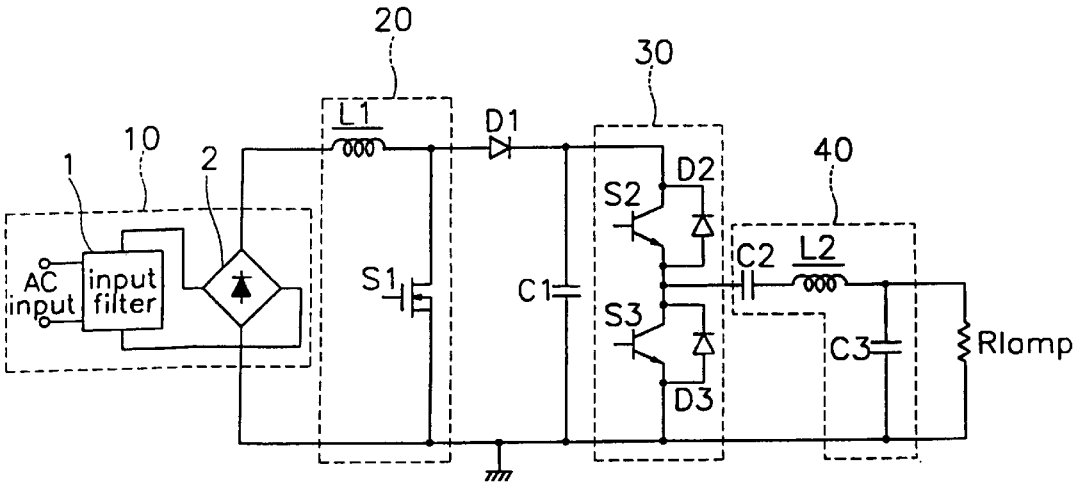
FIG. 1 is a circuit diagram of a conventional electronic ballast using a boost converter and half bridge converter.
Figure 2:
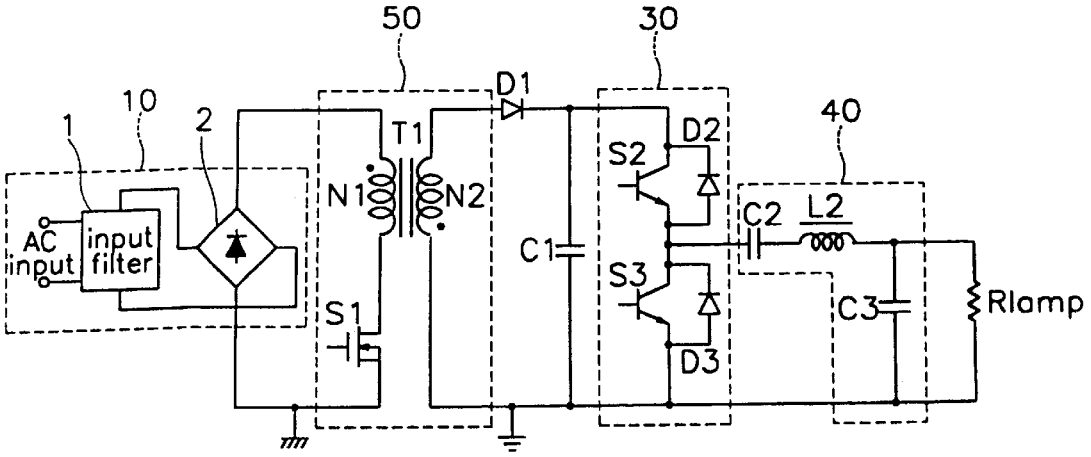
(PRIOR ART) FIG. 2
FIG. 2 is a circuit diagram of a conventional electronic ballast using a flyback converter and half bridge converter.
Figure 3:
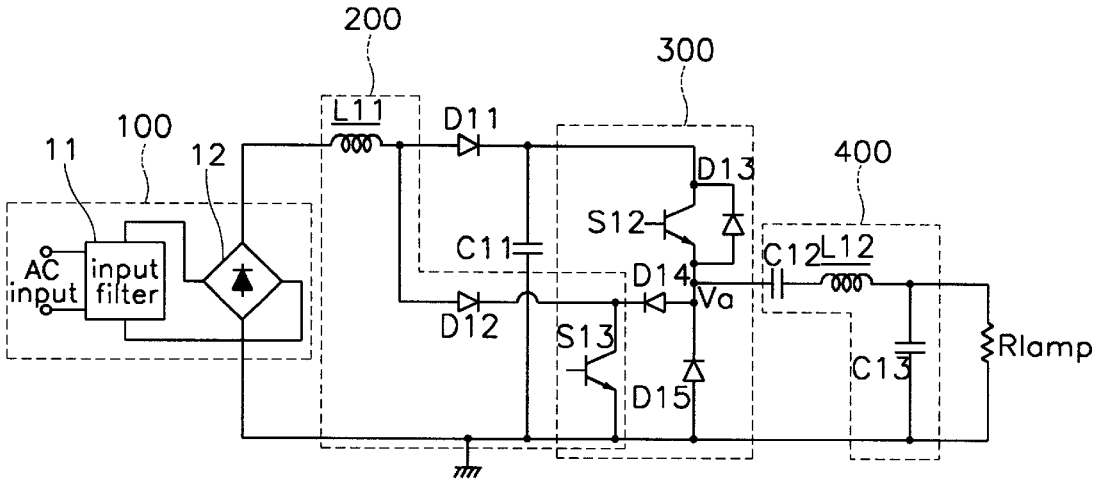
FIG. 3 is a circuit diagram of an electronic ballast according to a first preferred embodiment of the present invention.

FIG. 3 is a circuit diagram of an electronic ballast according to a first preferred embodiment of the present invention.

The electronic ballast comprises a rectifier 100, a boost converter 200, a diode D11, a capacitor C11, a half bridge converter 300, and a resonance circuit 400.

The rectifier 100 comprises a low pass filter 11 and a bridge diode 12. The low pass filter 11 is coupled to an AC current input terminal, and the bridge diode 12 is coupled to both ends of the low pass filter 11.

The boost converter 200 comprises an inductor L11, a diode D12, and a transistor S13, the transistor S13 functioning as a switch. One end of the inductor L11 is coupled to one end of the bridge diode 12, an anode of the diode D12 is coupled to the other end of the inductor L11, a collector of the transistor S13 is coupled to a cathode of the diode D12, and an emitter of the transistor S13 is grounded.

An anode of the diode D11 is coupled to the inductor L11 and the diode D12, one end of the capacitor C11 is coupled to a cathode of the diode D11, and the other end of the capacitor C11 is grounded.

The half bridge converter 300 comprises a transistor S12, which functions as a switch, and diodes D14 and D15. A collector of the transistor S12 is coupled to the diode D11 and the capacitor C11, an anode of the diode D13 is coupled to an emitter of the transistor S12, and a cathode of the diode D13 is coupled to a collector of the transistor S12. Further, an anode of the diode D14 is coupled to an emitter of the transistor S12, the collector of the transistor S13 is coupled to a cathode of the diode D14, a cathode of the diode D15 is coupled to the anode of the diode D14, and an anode of the diode D15 is grounded.

The resonance circuit 400 comprises capacitors C12 and C13 and an inductor L12. One end of the capacitor C12 is coupled to the transistor S12 and the diodes D14 and D15, one end of the inductor L12 is coupled to the other end of the capacitor C12, one end of the capacitor C13 is coupled to the other end of the inductor L12, the other end of the capacitor C13 is grounded, and both ends of the capacitor C13 are coupled to the lamp Rlamp.

An operation of the electronic ballast according to the first preferred embodiment of the present invention will now be described referring to drawings.

Figure 5A:
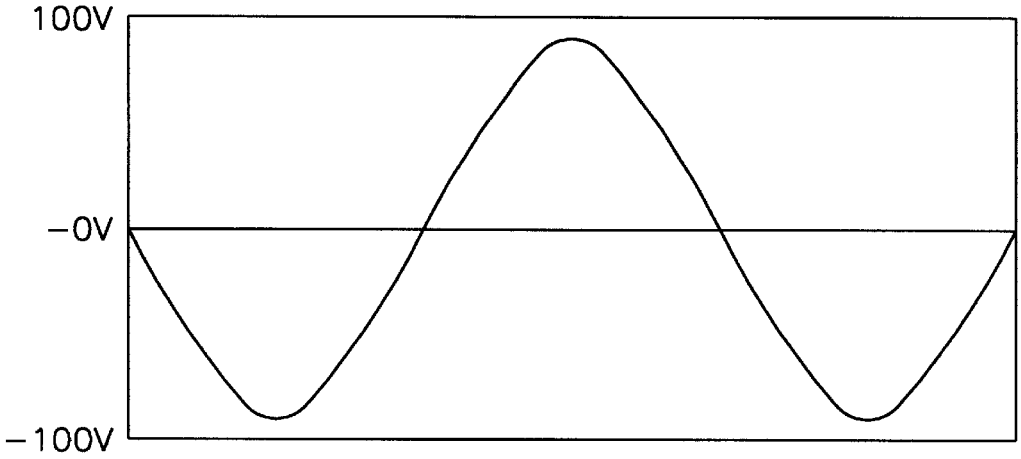
FIGS. 5A and 5B are waveform diagrams diagram of an operation of a boost converter according to the first preferred embodiment of the present invention.
Figure 5B:
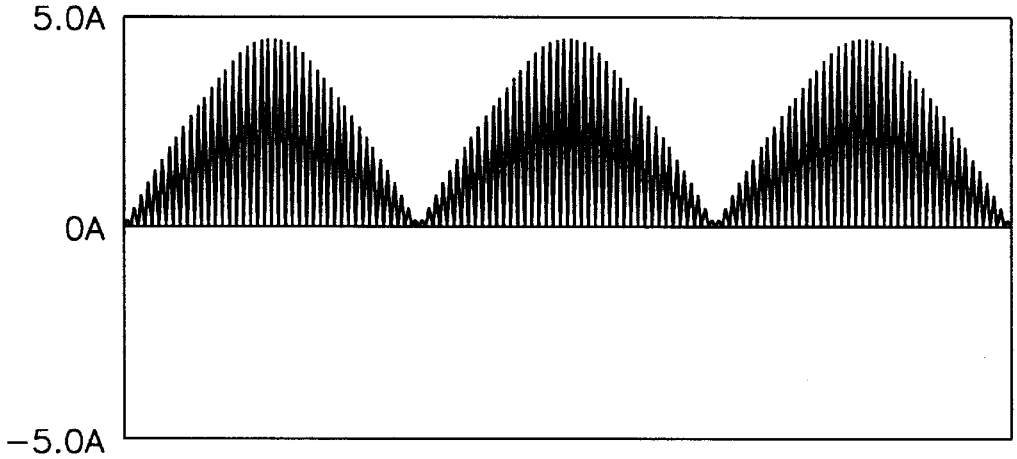
Figure 6:
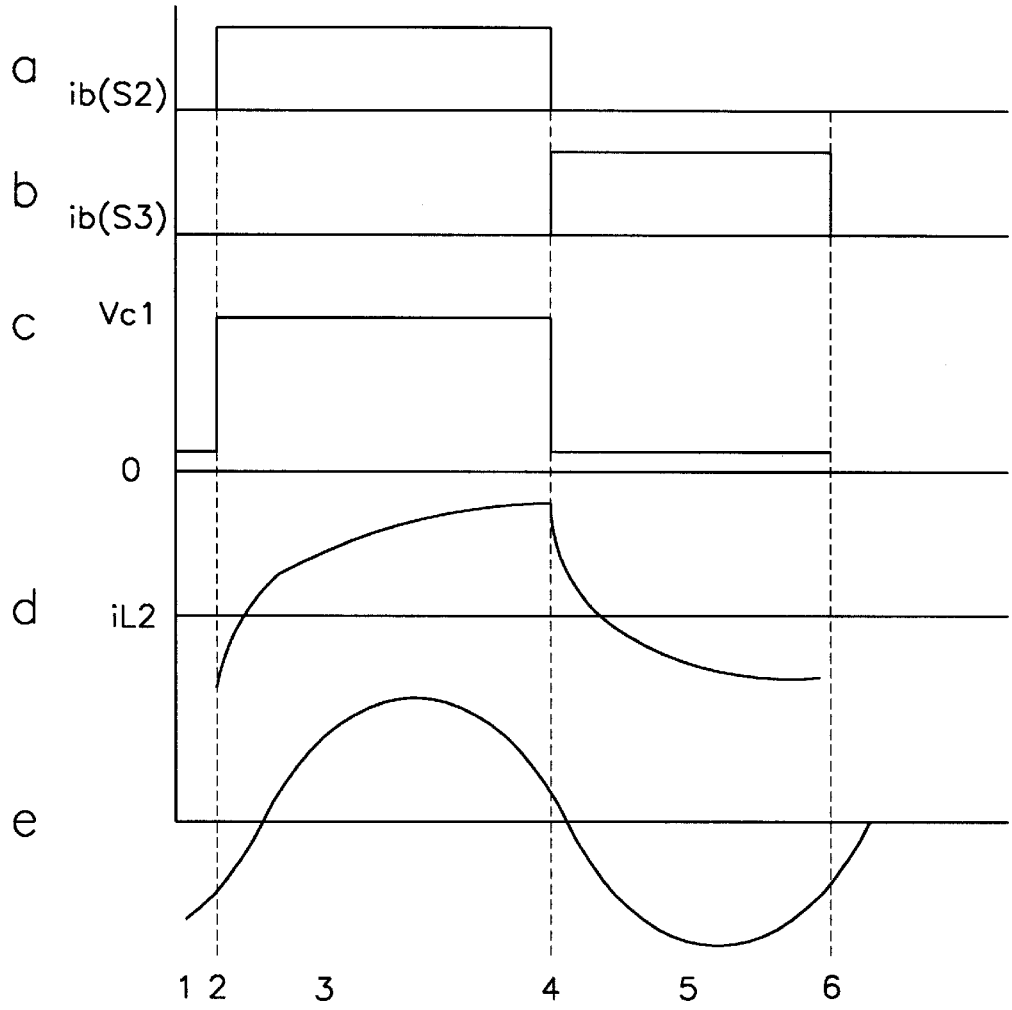
FIG. 6 is a waveform diagram of an operation of a half bridge converter according to the first preferred embodiment of the present invention.

FIG. 5 is a waveform diagram of an operation of the boost converter according to the first preferred embodiment of the present invention, and FIG. 6 is a waveform diagram of an operation of the half bridge converter according to the first preferred embodiment of the present invention. When the AC power is supplied to the low pass filter 11, the low pass filter 11 filters radio frequency (RF) components from the AC power before outputting the AC power as filtered output. The bridge diode 12 then rectifies the filtered output of the low pass filter 11. The output current of the bridge diode 12 is supplied to the inductor L 1.

FIG. 5(*a*) is a waveform diagram of the AC power initially input to the low pass filter 11, and FIG. 5(*b*) is a waveform diagram of the current flowing to the inductor L11 via the diode 12.

The output current of the bridge diode 12 is stored in the inductor L11 in the form of electric energy when the transistor S13 is turned on. When the transistor S13 is turned off, the energy stored in the inductor L11 is sent to the half bridge converter 300. The current supplied from the inductor L11 is supplied to the capacitor C11, and the capacitor C11 smoothes the current supplied to the inductor L11 and charges the inductor L11.

The diode D12 prevents the current of the half bridge converter 300 from flowing to the boost converter 200, and the diode D14 prevents the current of the boost converter 200 from flowing to the half bridge converter 300.

The operation of the half bridge converter 300 will now be described.

The two transistors S12 and S13, respectively of the half bridge converter 300 and the boost converter 200, perform opposite on and off operations so that a voltage of near square-wave form is supplied to the capacitor C12, the capacitor C12 forming a resonance circuit.

That is, when the transistor S12 is on, the transistor S13 is off, and when the transistor S12 is off, the transistor S13 is on. If the transistor S12 is turned on, the energy stored in the capacitor C11 is transmitted to the resonance circuit 400 via the transistor S12, and if the transistor S13 is turned on, the direction of the current flowing to the inductor L12 of the resonance circuit 400 changes to a direction opposite that when the transistor S12 is turned on.

The current supplied from the half bridge converter 300 is resonated by the resonance circuit 400 and is converted to AC current.

A voltage Vlamp measured by a current iL12 flowing to the inductor L12 and an equivalent resistance of the lamp Rlamp is shown by d and e of FIG. 6.

As a result, the voltage having a waveform of e of FIG. 6 is supplied to the discharge tube lamp.

In the preferred embodiment of the present invention, the conventional method of using a separate switch for each the boost converter 200 and half bridge converter 300 is replaced by the on and off switching operation of the half bridge converter 300.

This is made possible for the reason as follows. When the upper switch of the half bridge converter 300 is turned on and the lower switch is turned off, the energy stored in the capacitor C11 is transferred to the half bridge converter 300, and when the lower switch of the half bridge converter 300 is turned on and the upper switch is turned off, the capacitor C11 is charged by the diode D11, and concurrently, the current is supplied by the diode D12 and transistor S13. On the other hand, when the switch of the boost converter 200 is turned on, the current is not supplied to the half bridge converter 300, but when the switch of the boost converter 200 is turned off, the current is supplied to the half bridge converter 300. Therefore, if a switch duty ratio of the boost converter 200 is limited to below 50%, when the switch of the boost converter 200 and the switch of the half bridge converter 300 are shared, no problems are encountered in the operation of the converters 200 and 300.

Hence, an electronic ballast can be implemented which comprises a system that shares the lower switch of the half bridge converter 300, and the transistor S13 of the boost converter and is controlled by the operation of the shared switch.

Figure 4:
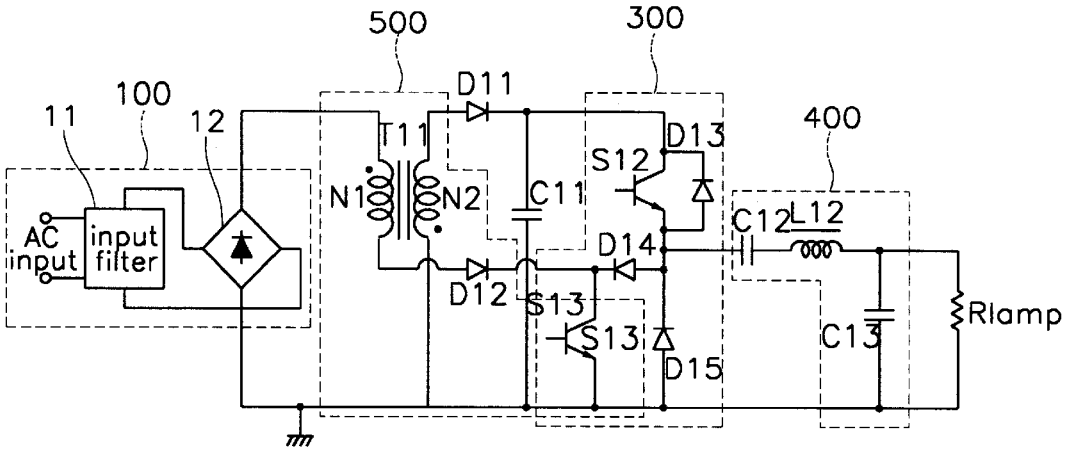
FIG. 4 is a circuit diagram of an electronic ballast according to a second preferred embodiment of the present invention.

FIG. 4 is a circuit diagram of an electronic ballast according to a second preferred embodiment of the present invention.

The electronic ballast comprises a rectifier 100, a flyback converter 500, a diode D11, a capacitor C11, a half bridge converter 300, and a resonance circuit 400.

The rectifier 100 comprises a low pass filter 11 and a bridge diode 12. The low pass filter 11 is coupled to an AC current input terminal, and the bridge diode 12 is coupled to both ends of the low pass filter 11.

The flyback converter 500 comprises a transformer T11, a diode D12, and a transistor S13. A primary coil of the transformer T11 is coupled to one end of the bridge diode 12, and an anode of the diode D12 is coupled to a secondary coil of the transformer T11. Also, a collector of the transistor S13 is coupled to a cathode of the diode D12, and an emitter of the transistor S13 is grounded.

An anode of the diode D11 is coupled to the secondary coil of the transformer T11, and one end of the capacitor C11 is coupled to a cathode of the diode D11 and its other end is grounded. The half bridge converter 300 comprises a transistor S12 and diodes D13, D14, and D15. A collector of the transistor S12 is coupled to the diode D11 and capacitor C11, an anode of the diode D13 is coupled to an emitter of the transistor S12, and a cathode of the diode D13 is coupled to the collector of the transistor S12. An anode of the diode D14 is coupled to the emitter of the transistor S12, the collector of the transistor S13 is coupled to a cathode of the diode D14, a cathode of the diode D15 is coupled to the anode of the diode D14, and an anode of the diode D15 is grounded.

The resonance circuit 400 comprises capacitors C12 and C13 and an inductor L12. One end of the capacitor C12 is coupled to the transistor S12 and diodes D14 and D15, one end of the inductor L12 is coupled to the other end of the capacitor C12, one end of the capacitor C13 is coupled to the other end of the inductor L12, the other end of the capacitor C13 is grounded, and a lamp Rlamp is coupled to the capacitor C13.

An operation of the electronic ballast according to the second preferred embodiment of the present invention will now be described referring to drawings.

When the AC power is input to the low pass filter 11, RF components of the sine wave AC power is filtered and output, and the bridge diode 12 rectifies the filtered output of the low pass filter 11.

FIG. 5(*b*) is a waveform diagram of the current rectified by the bridge diode 12 of the first preferred embodiment of the present invention. This current is provided to the primary coil of the transformer T11. When the switch S13 is turned on, the current provided from the bridge diode 12 is stored in the primary coil, and when the switch S13 is turned off, the current stored in the primary coil is transmitted to the secondary coil.

The current provided to the secondary coil is stored in the capacitor C11, and subsequent operations are identical with that of the first preferred embodiment of the present invention. The switch can also be shared to have effects identical to the first preferred embodiment of the present invention.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. An electronic ballast, comprising:

a rectifier receiving and rectifying an alternating current (AC) power and outputting a resulting output current;

a first converter receiving the output current of the rectifier and changing levels of the voltage by the on and off operations of a first switch and outputting a resulting output current;

a half bridge converter coupled to the first converter in parallel and comprising first and second switches wherein the first switch is being shared with the first converter, the half bridge converter receiving the output current of the first converter and changing a flow direction of the current according to on and off states of the first and second switches; and a resonance circuit, coupled to the half bridge converter, resonating an output current of the half bridge converter to convert the current into a sine wave current and outputting the current to a discharge lamp.

2. The ballast of claim 1, wherein the first and second switches are transistors that receive control signals through bases to perform the on and off operations.

3. The ballast of claim 1, wherein the electronic ballast further comprises a first diode that is coupled between the first converter and the half bridge converter in the forward direction of the half bridge converter and prevents reverse flow from the half bridge converter to the first converter; and a first capacitor that is coupled to the first diode, the half bridge converter, and the ground, and smoothes and maintains the output current of the first converter.

4. The ballast of claim 1, wherein the first converter is a boost converter.

5. The ballast of claim 4, wherein the boost converter comprises a first inductor coupled between an output terminal of the rectifier and an anode of a first diode, and wherein the first switch is coupled between the first inductor and the ground.

6. The ballast of claim 5, wherein the boost converter further comprises a second diode, an anode of which is coupled to the first inductor and a cathode of which is coupled to the first switch to prevent the flow of current from the half bridge converter.

7. The ballast of claim 1, wherein the first converter is a flyback converter.

8. The ballast of claim 7, wherein the flyback converter comprises a transformer that is coupled to the rectifier and receives the output current of the rectifier at a primary coil of the transformer and transfers energy to a secondary coil of the transformer with different voltage magnitudes, and wherein the first switch is coupled between the primary coil of the transformer and the ground and controls the transfer of energy to the secondary coil of the transformer by its on and off operations.

9. The ballast of claim 8, wherein the flyback converter further comprises a diode, an anode of which is coupled to the primary coil of the transformer and a cathode of which is coupled to the first switch to prevent the reverse flow of the current of the half bridge converter.

10. The ballast of claim 1, wherein the second switch of the half bridge converter is coupled to a first capacitor and a first diode, the first and second switches performing opposite on and off operating such that when the first switch is controlled to on the second switch is controlled to off and vice versa.

11. The ballast of claim 10, wherein the half bridge converter further comprises a diode, a cathode of which is coupled to the first switch and an anode of which is coupled to the second switch to prevent the flow of current from the first converter.

12. The ballast of claim 1, wherein the resonance circuit comprises a first capacitor coupled to the first and second switches; an inductor coupled to the first capacitor; and a third capacitor coupled between an inductor and the ground.

* * * * *

UNITED STATES PATENT AND TRADEMARK OFFICE

CERTIFICATE OF CORRECTION

PATENT NO. : 6,225,753 B1
DATED : May 1, 2001
INVENTOR(S) : Lee

It is certified that error appears in the above-identified patent and that said Letters Patent is hereby corrected as shown below:

Title page,
Item [75], Inventor, please delete "Bucheon" and insert -- Bucheon City --.

Column 2,
Line 65, please delete "waveform diagrams diagram" and insert -- waveform diagrams --.

Column 8,
Line 7, please replace "third capacitor" with -- second capacitor --.

Signed and Sealed this

Eighteenth Day of December, 2001

*Attest:*

*Attesting Officer*

JAMES E. ROGAN
*Director of the United States Patent and Trademark Office*